US008881809B2

(12) United States Patent
Verret et al.

(10) Patent No.: US 8,881,809 B2
(45) Date of Patent: Nov. 11, 2014

(54) WIRELESS TAG TRACER METHOD AND APPARATUS

(71) Applicants: Robin J. Verret, Youngsville, LA (US); Michael J. Kilchrist, Lafayette, LA (US)

(72) Inventors: Robin J. Verret, Youngsville, LA (US); Michael J. Kilchrist, Lafayette, LA (US)

(73) Assignees: Robin James Verret, Milton, LA (US), part interest; Turbo-Chem International, Inc., Scott, LA (US), part interest ( * ) Notice: Subject to any disclaimer, the term of this patent is extended or adjusted under 35 U.S.C. 154(b) by 0 days.

(21) Appl. No.: 13/780,029

(22) Filed: Feb. 28, 2013

(65) Prior Publication Data

US 2013/0175024 A1 Jul. 11, 2013

Related U.S. Application Data

(60) Division of application No. 12/201,106, filed on Aug. 29, 2008, now Pat. No. 8,397,810, which is a continuation-in-part of application No. 12/145,726, filed on Jun. 25, 2008, now abandoned.

(60) Provisional application No. 60/945,968, filed on Jun. 25, 2007.

(51) Int. Cl.
*E21B 47/12* (2012.01)
*E21B 47/10* (2012.01)

(52) U.S. Cl.
CPC ..... *E21B 47/1015* (2013.01); *E21B 47/10* (2013.01)
USPC ..... 166/250.12; 175/40

(58) Field of Classification Search
None
See application file for complete search history.

(56) References Cited

U.S. PATENT DOCUMENTS

| | | | | |
|---|---|---|---|---|
| 3,550,696 | A | 12/1970 | Kenneday | |
| 6,324,904 | B1 | 12/2001 | Ishikawa et al. | |
| 2004/0020645 | A1 | 2/2004 | Clark et al. | |
| 2004/0162224 | A1 | 8/2004 | Nguyen et al. | |
| 2005/0011645 | A1 | 1/2005 | Aronstam et al. | |
| 2005/0230110 | A1 | 10/2005 | Ellison et al. | |
| 2006/0000604 | A1 | 1/2006 | Jenkins et al. | |
| 2006/0037779 | A1 | 2/2006 | Moeny et al. | |
| 2008/0236814 | A1 | 10/2008 | Roddy | |
| 2008/0262735 | A1* | 10/2008 | Thigpen et al. | 702/6 |
| 2010/0050905 | A1* | 3/2010 | Lewis et al. | 106/638 |
| 2010/0051275 | A1 | 3/2010 | Lewis et al. | |
| 2011/0163857 | A1* | 7/2011 | August et al. | 340/10.42 |

* cited by examiner

*Primary Examiner* — Zakiya W Bates
(74) *Attorney, Agent, or Firm* — Garvey, Smith, Nehrbass & North, L.L.C.; Charles C. Garvey, Jr.; Seth M. Nehrbass

(57) ABSTRACT

Wireless tag fluid tracking system. A fluid can be tracked in a wellbore utilizing at least one WID tag, such as an LW tag or an RFID tag, entrained in the fluid. A WID tag reader can be disposed and/or displaced in the wellbore, for example, on a drill string or a casing string. A reader can be utilized to locate the at least one WID tag in the wellbore. A reader can be housed in a drill string sub. A fluid entrained with at least one WID tag can be utilized as a tracer fluid. A WID tag can be entrained in cement or a drilling or fracture fluid.

21 Claims, 8 Drawing Sheets

WIRELESS TAG TRACER METHOD AND APPARATUS

CROSS REFERENCE TO RELATED APPLICATIONS

This application is a divisional of U.S. Ser. No. 12/201,106, filed Aug. 29, 2008, now U.S. Pat. No. 8,397,810, which is a continuation-in-part of U.S. Ser. No. 12/145,726, filed Jun. 25, 2008, abandoned, which is a nonprovisional of U.S. 60/945,968, filed Jun. 25, 2007.

BACKGROUND

The invention relates generally to an apparatus and method to track a fluid with a wireless tracking device entrained in the fluid.

It can be desirable to track a fluid in a wellbore, e.g., a wellbore in a formation for the recovery of hydrocarbons. Tracking a fluid can include determining the location of a fluid loss zone and/or the location of a fluid itself, e.g., drilling mud, cement, etc., in the wellbore. One way of identifying a possible location of a loss zone, e.g., lost circulation, is to use a noise log, which measures any increase in movement or activity in a wellbore based on the change in tone or volume in the noise of flowing fluid at a certain depth, using specialized logging tools. Another method of identifying a possible location of a loss zone, as well as evaluating a cement or hydraulic fracture treatment, is to use a temperature log, which measures changes and/or variance in temperature, again using specialized logging equipment. Both of these methods can be imprecise and/or fail their intended purpose.

A tracer which has been used for decades is a radioactive isotope in, most commonly, powdered form and placed in a carrier fluid and pumped down hole. The location of the radioactivity is searched, for example, to determine an exit point or concentration somewhere in the wellbore. In the U.S., for example, stringent Occupational Safety & Health Administration (OSHA) and/or environmental regulations can impede use of radioactive tracers.

SUMMARY OF THE INVENTION

A wireless tag can be entrained in a fluid to allow tracking of the fluid within a wellbore. In one embodiment, a method of tracking a fluid, which can be in a wellbore, can include entraining at least one electronic tracking device in the fluid; and tracking the electronic tracking device with at least one receiver. A method of tracking a fluid, which can be in a wellbore, can include entraining at least one wireless identification (WID) tag in the fluid, and locating the at least one WID tag in the wellbore with at least one reader. The WID in one embodiment can be a radio frequency identification (RFID) tag; and in another embodiment, a long wavelength identification (LW) tag.

The method can include injecting a slurry of the at least one WID tag and the fluid into the wellbore. The method can include injecting a slurry of the at least one WID tag and the fluid into an annulus between an outer surface of a first casing string disposed in the wellbore and at least one of the wellbore and an inner surface of a second casing string circumferential to the first casing string. The method can include determining when the fluid is injected to a desired location in the annulus and/or wellbore. The method can include injecting a slurry of the at least one WID tag and the fluid into an annulus between an outer surface of a drill string and the wellbore. The method can include disposing and/or displacing the at least one reader in the wellbore. The method can include disposing the at least one reader in the wellbore on a drill string.

The entraining step can include entraining a plurality of WID tags in the fluid. The method can include detecting a fluid loss by locating a concentrated zone of the plurality of WID tags in the wellbore. The method can include entraining the plurality of WID tags substantially uniformly in the fluid. The method can include detecting a fluid void by locating a zone in the wellbore substantially devoid of the plurality of WID tags. The method can include transmitting sensor data from the at least one WID tag to the reader and/or writing data to the at least one WID tag, e.g., with the reader.

In another embodiment, a drilling fluid composition can include a drilling fluid, and at least one WID tag entrained in the drilling fluid.

In another embodiment, a fracturing fluid composition can include a fracturing fluid, and at least one WID tag entrained in the fracturing fluid.

In yet another embodiment, a cement composition can include a cement, and at least one WID tag entrained in the cement. The cement can be solidified or fluidic, e.g., during a pumping step.

In another embodiment, a tracer slug can include a fluid, and at least one WID tag entrained in the fluid.

In yet another embodiment, a system to track a fluid, which can be in a wellbore, can include at least one WID tag entrained in the fluid, and at least one reader. The at least one reader can be disposed within the wellbore. The at least one reader can be disposed on a drill string or a casing string.

In another embodiment, a drill string sub can include a sub body having at least one connection to a drill string, and at least one WID tag reader disposed on the sub body.

In embodiments, the WID tag can be an RFID, an LWID, a combination thereof, or the like.

DETAILED DESCRIPTION OF THE INVENTION

Figure 1:
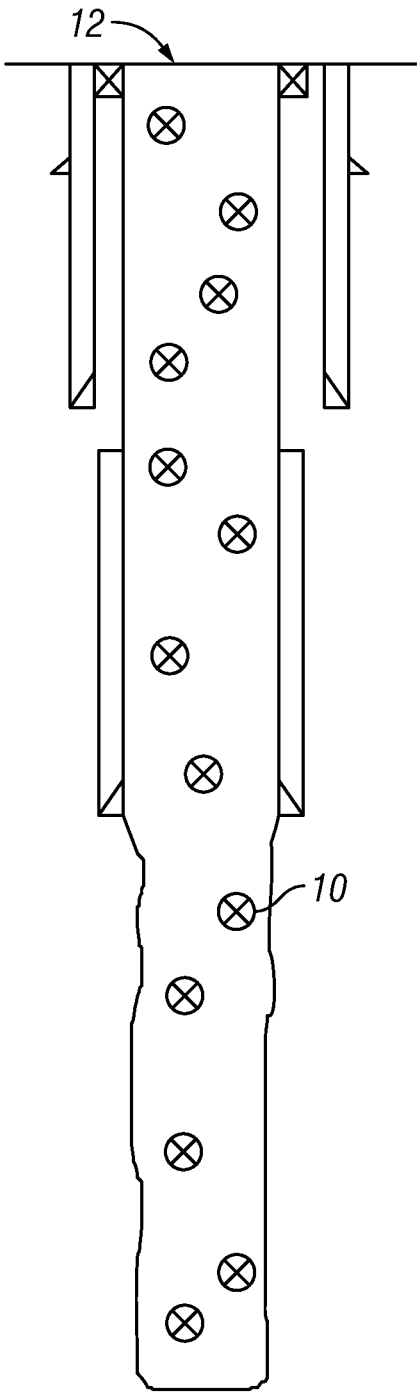
FIG. 1 is a schematic diagram showing wireless identification (WID) tags suspended in fluid pumped into a well according to an embodiment of the invention.

The invention relates generally to an apparatus and method of tracking a fluid in a wellbore with at least one electronic tracking device entrained therein; or more particularly, with at least one wireless identification (WID) tag entrained therein.

In one embodiment the WID tag can be a radio frequency identification (RFID) tag. Generally, an RFID tag is a device that transmits identification information to a reader, also referred to as an interrogator. RFID tags typically include an antenna and means to transmit a signal corresponding to a data representation, e.g., a microchip or piezoelectric crystals with reflectors on the surface thereof. RFID technology was previously claimed in U.S. Pat. No. 3,054,100, herein incorporated by reference.

In another alternative or additional embodiment, the WID tag can be a long wavelength identification (LW) tag. In an embodiment, the LW tag can operate at a long wavelength such as less than about 450 KHz, low speed such as about 300 to 9600 baud, low power, and medium range such as about 15 to 30 meters (about 50 to 100 feet). The LW tags in one embodiment can employ the IEEE Standard 1902.1, also known as RuBee or RuBee IV, which enables low speed, low cost sensor and visibility networks in harsh environments, with battery/power source lives of up to 10 years or more using a quarter-sized CR2525 Li battery. In the context of one embodiment of wellbore fluid tracking where long battery life is not as much of a concern considering the duration of the job, a reduced battery size can be used in one embodiment to facilitate LW entrainment.

Whereas RFID tags use a non-radiating, back-scattered communications mode which can eliminate the battery, crystal and other external components, LW tags can provide tag networking capabilities. On the other hand, the IEEE Standard 802.11 uses a radiating transceiver mode wherein the tags may have near-unlimited memory with flexible internet protocol (IP) addresses for managing high bandwidth, high volume data from relatively few tags, and high power requirements for high frequencies which lead to short battery lives; IEEE Standard 802.15.4e devices may have improved battery life, but similar tag count networking issues; and both IEEE 802.11 and 802.15.4e use frequencies over one gigahertz, which cannot perform near liquids or near steel.

The LW tags in an embodiment are active transceivers that can function with IP addresses and peer-to-peer, on-demand communications, with a suitable range to work as a local network. In the LW peer-to-peer system, the tags are clients and the readers are servers. LW tags in one embodiment can consume only a few microamps in standby and less than 1 milliamp in active mode, and may be fully programmable using low cost 4-bit processors capable of encryption and decryption and complex functions associated with managing IP addresses (DCHP, ARP). In an embodiment, LW tags may optionally be equipped with sensors, sRAM, displays, LEDs and the like. In alternative or additional embodiments, LW tags can eliminate or reduce the size of the battery and operate with a reduced range. Networks of up to thousands of peer-to-peer LW tags can work in one embodiment as a reliable visibility network. LW tags in one embodiment are not affected by liquids, can be used underwater or in fluids, and are minimally affected by ferromagnetic materials such as steel.

There are several methods of identification, including, but not limited to, storing a unique number, such as a serial number or IP address that identifies the WID tag. A reader can convert a signal reflected back or transmitted from the WID tag into digital information, e.g., the unique number or other information such as, but not limited to, depth, direction, GPS location, pressure, temperature, velocity, acceleration, radiation, etc., that can then be passed on, for example, to computer(s) that can make use of it. In one embodiment, multiple receptions of tag transmission can triangulate tag position to give precise location information such as depth and horizontal coordinates. A reader can operate in real-time and/or as needed.

In one embodiment, LW tags in a peer-to-peer network can effectively account for all tag positions in the network. In an embodiment, the LW tags can have the capability to transmit data over the internet, thereby allowing each tag to be searched via an internet search browser, e.g., GOOGLE. In an embodiment, partners involved in drilling operations can retrieve ongoing data in real time, so as to keep up with ongoing events, and to allow geologists, geophysicists, engineers, etc., to monitor the drilling process from an onsite or remote location anywhere in the world with internet access and to determine if a well is productive, correlating with offsets, needs to be drilled deeper, etc. In this embodiment, adjusting the drilling process or parameters in response to the data acquired or derived from the LW tags can facilitate economization of well costs, especially in the deepwater arena where rig time is very expensive.

In an embodiment, a WID tag can be in communication with a sensor or include a sensor therewith, for example, to measure depth, direction, GPS location, pressure, temperature, velocity, acceleration, radiation, etc. GPS location of a drilling fluid via entrained WID tag(s) can be utilized, for example, in directional drilling control.

A WID tag, including a microchip, piezoelectric crystal, battery, and/or antenna thereof, can be encapsulated, for example, in a housing, e.g., spherical, and/or resin, such as epoxy. An antenna can extend within an encapsulation material and/or externally from an encapsulation material. The encapsulation material(s) can be a polymer, e.g., plastic. Encapsulation material can have a low dielectric constant, for example, less than about 20, 10, 0.1, 0.01, 0.001, 0.0001, 0.00001, or any range therein. Encapsulation material(s) can be malleable and/or resilient. The encapsulation material(s) can include, but is not limited to, those measured on the Shore A or B durometer hardness scale. An encapsulation material can have a Shore A or B hardness of about 0, 1, 5, 10, 15, 20, 25, 30, 35, 40, 45, 50, 55, 60, 65, 70, 75, 80, 85, 90, 95, 100, or any range therein. An encapsulation material can be relatively softer than the pumping surface of a pump transporting a slurry of fluid and WID tag(s), e.g., to minimize damage to the pump and/or WID tag(s).

The size of a WID tag, including a microchip, piezoelectric crystal, battery and/or antenna(e), can be design selected. Miniaturized embodiments developed by Hitachi, Ltd., for example, include an RFID microchip that is 0.05 millimeters square and 5 microns thick and another that is 0.4 millimeters square and 0.12 millimeters thick. The concentration of WID tags in a fluid can be design selected. WID tags can be safer and/or more accurate than other tracking methods.

WID tags can be active, passive, or even semi-passive. An active WID tag typically includes a battery to power a microchip's circuitry and to broadcast a signal to a reader. Passive tags typically have no battery, but draw power from electromagnetic waves emanating from the reader that induce a current in the tag's antenna. Semi-passive WID tags typically use a battery to run the microchip's circuitry, but communicate by drawing power from the reader.

WID tags can be read-only or read and/or write tags. Writing and/or reading of data to a WID tag is known to one of ordinary skill in the art. In one embodiment, a WID tag can include memory to store data, e.g., until it is transmitted to a reader. A WID tag can include a sensor automatically writing data to the memory of the WID tag. WID tag(s) with an appropriate read range (e.g., distance between WID tag and reader) can be selected. WID tag(s) with a desired frequency of use can be selected, for example, low (less than 450 KHz, e.g., about 125 KHz), high (about 13.6 MHz), ultra high frequency (UHF) (about 850 to about 900 MHz), or microwave (about 2.45 GHz). Writing data can include marking those WID tags disposed in a location of interest. For example, WID tags in a zone of high WID tag concentration, which can indicate a loss zone, can be marked such that one can specifically track those WID tags, e.g., if they migrate from and/or within the loss zone.

A WID tag can include, but is not limited to, an integrated circuit (IC) type of tag and/or a surface acoustic wave (SAW) type of tag. An IC based tag, e.g., a transponder and backscatter tag, can include a microelectronic semiconductor device comprising interconnected transistors. A SAW based tag can include passive crystal devices. In one embodiment, a SAW tag utilizes piezoelectric crystals with reflectors at pre-determined intervals or locations to represent the tag's data, which can be read by variations in amplitude, time, phase and/or other variables. When incoming radio energy is transmitted along the surface of the SAW tag, each reflector reflects part of the signal back. The spacing of these reflections, i.e., echoes, indicates the location and relative position of each reflector of that tag. The position of each reflector can then be calculated and translated into a data representation, e.g., corresponding to an identification number. SAW types of tags can be read through drilling mud, sea water, bromides, chlorine, and cement, for example. SAW types of tags can withstand temperatures up to about 400° C. (752° F.) and pressures up to about 140,000,000 Pa (20,000 psi).

At least one WID tag can be entrained in a fluid, which can be a liquid and/or a gas. Entraining can include suspending or substantially suspending a WID tag(s) in the fluid. For example, a WID tag can have the same or substantially the same density as the fluid. A plurality of WID tags can be entrained in the fluid, e.g., substantially uniformly entrained. WID tags can be at a concentration of about 1, 10, 20, 50, 100, 1000, 5000, 10000, 100000, 1000000 per cubic meter of fluid. A suitable concentration of WID tags to utilize in a fluid can be determined from tolerable loss volumes of fluid. In one embodiment, the number of WID tags in a fracture or other fluid loss zone depends on the volume of leak rate, the concentration of WID tags in the carrier fluid, and the amount of time; assuming all or most of the tags can be detected or read during entry or after deposition in the fracture, the number of tags detected can correlate with the amount of fluid lost.

FIG. 1 is a schematic diagram showing WID tags 10 suspended in fluid pumped into a well 12 according to an embodiment of the invention. A WID tag(s) can be added to the fluid before it is in the wellbore, for example, at least one WID tag and the fluid can be mixed, e.g., at the surface, to form a slurry. The slurry can be pumped or otherwise disposed into the wellbore. For example, WID tag(s) can be released, e.g., from a downhole sub, into the fluid. A fluid and/or WID tag can be design selected to allow substantially uniform entrainment and/or suspension in a dynamic and/or static fluid.

Figure 2:
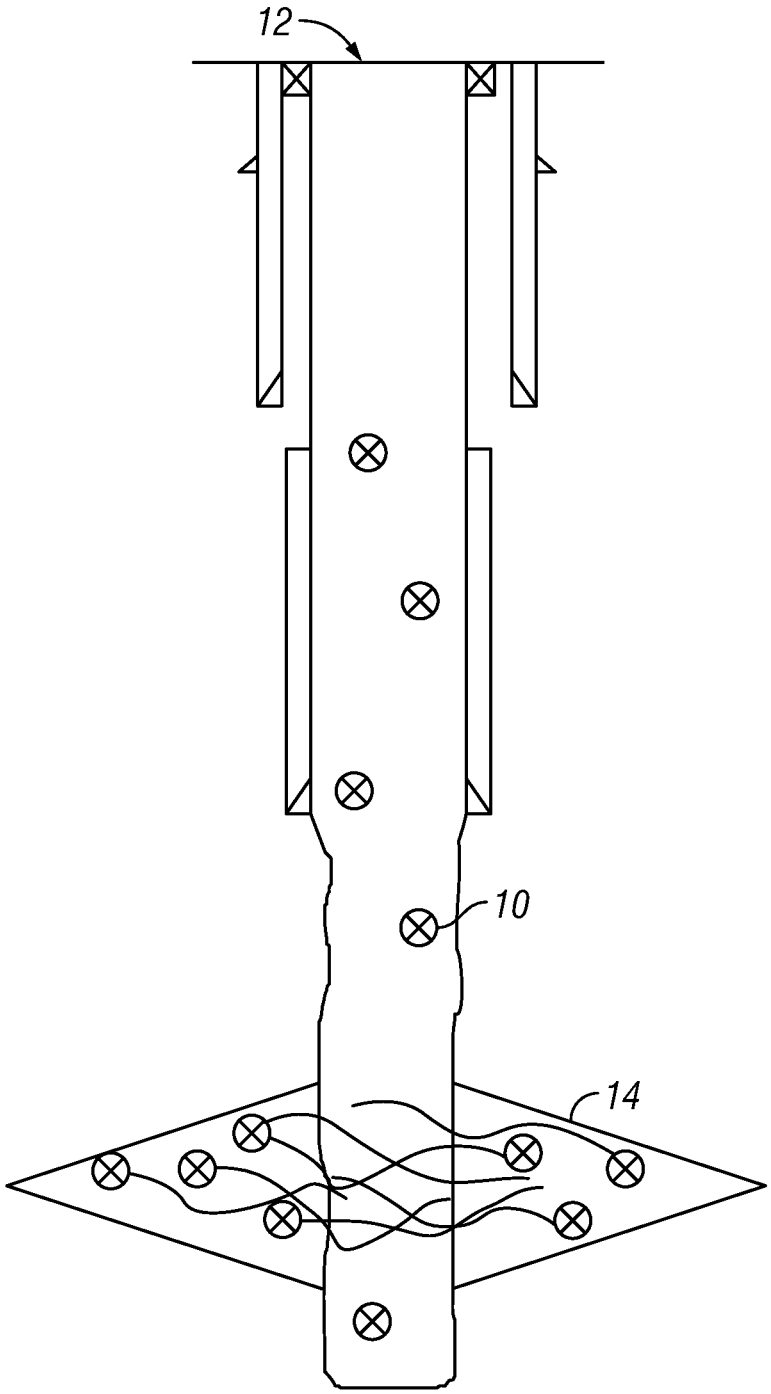
FIG. 2 is a schematic diagram showing WID tags entrained in a circulating drilling fluid and accumulated in the vicinity of a thief zone according to an embodiment.

FIG. 2 is a schematic diagram showing WID tags 10 entrained in a drilling fluid circulated in the well 12 and accumulated in the vicinity of a thief zone 14 according to an embodiment. The WID tags can be continuously present in a drilling mud while drilling commences for more or less continuous or periodic loss zone monitoring, in an embodiment, the WID tags are continuously added to the drilling mud, e.g. to make up for lost or damaged tags in the recirculated mud. Alternatively or additionally, the WID tags can be used in a pill or slug of fluid used to locate the thief zone 14. If desired, "used" WID tags can be recovered for re-use from the fluid upon return to the surface by screening, magnetic separation, flotation, or other physical separation process.

Figure 3:
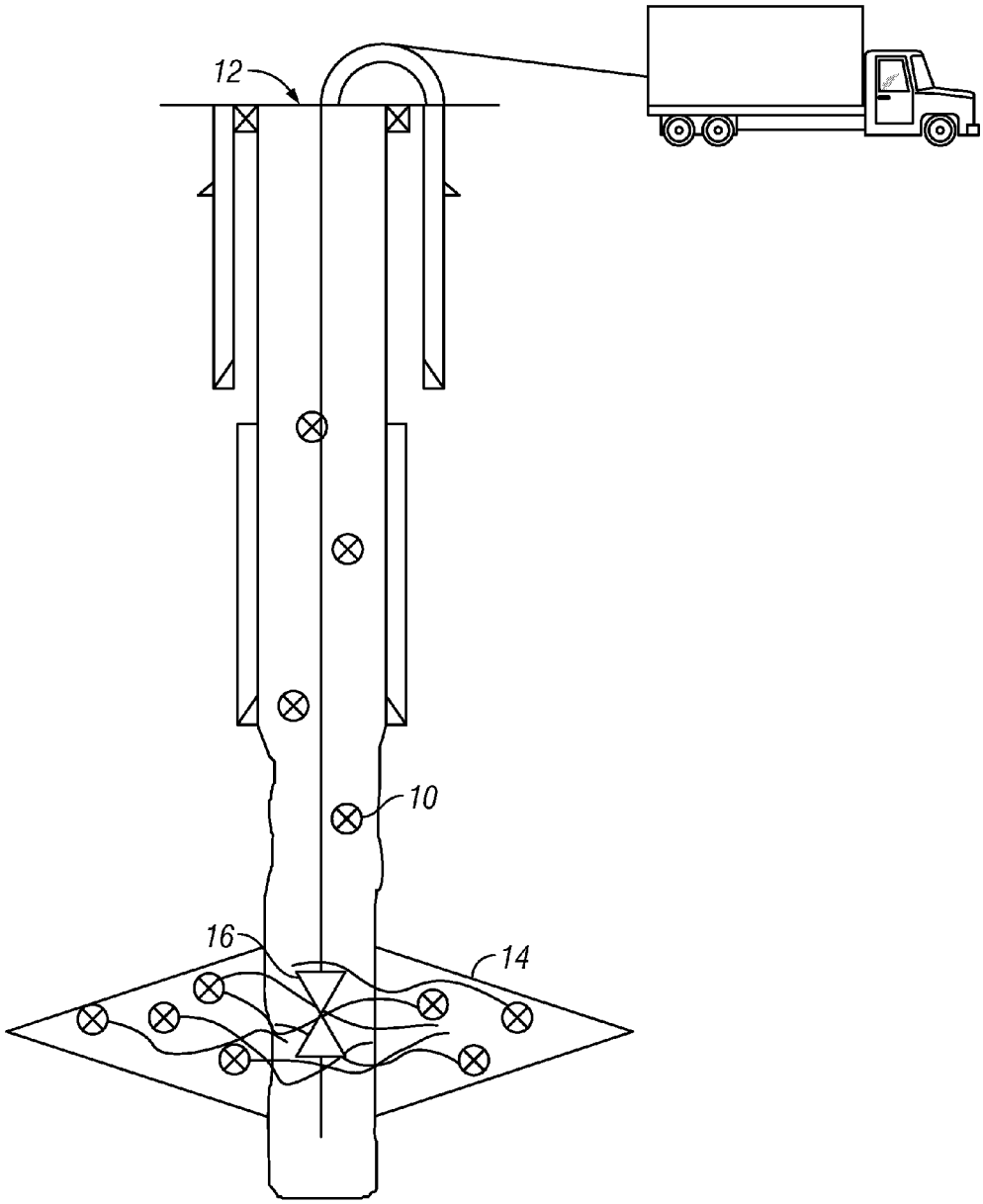
FIG. 3 is a schematic diagram showing WID tags in the thief zone of FIG. 2 transmitting their location to a wireline reader in the wellbore according to an embodiment.
Figure 4:
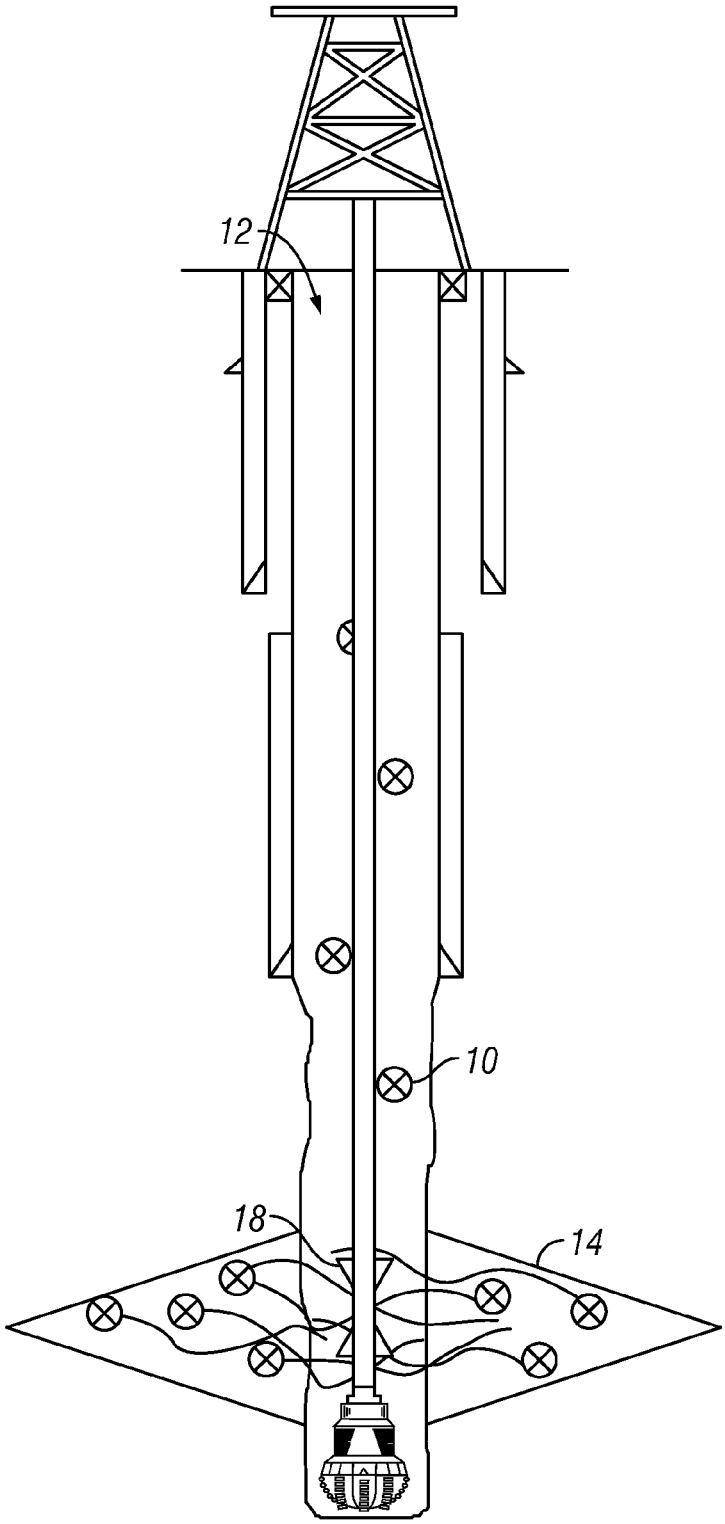
FIG. 4 is a schematic diagram showing WID tags in the thief zone of FIG. 2 transmitting their location to a drill pipe reader in the wellbore according to an embodiment.

FIG. 3 is a schematic diagram showing WID tags 10 in the thief zone 14 transmitting their location to a wireline reader 16 in the wellbore 12 according to an embodiment. FIG. 4 is a schematic diagram showing WID tags 10 in the thief zone 14 transmitting their location to a drill pipe reader 18 in the wellbore 12 according to an embodiment.

Figure 5:
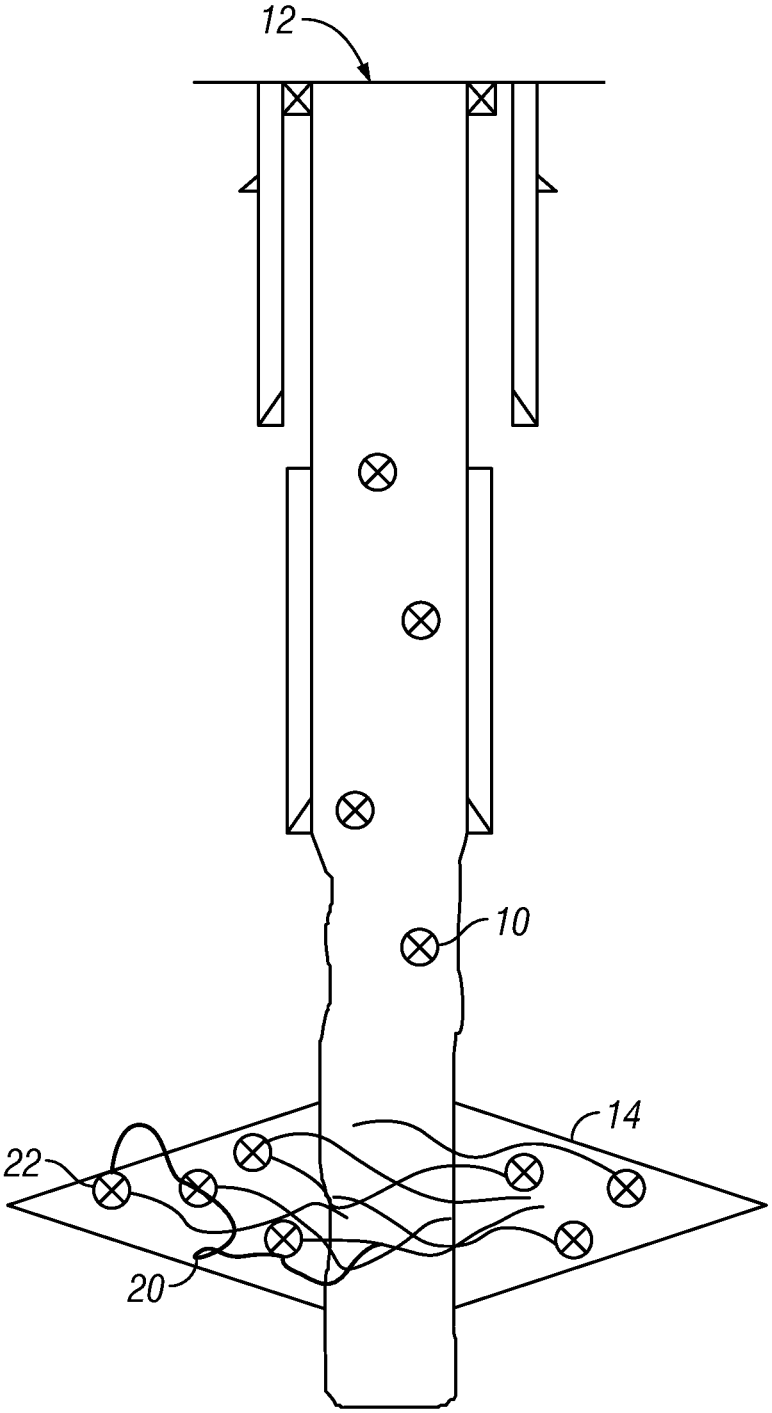
FIG. 5 is a schematic diagram showing WID tags in the thief zone of FIG. 2 wherein the tags comprise long wavelength identification (LW) tags in peer-to-peer communication to relay information such as location from tags beyond range to a reader in the wellbore according to an embodiment.
Figure 6:
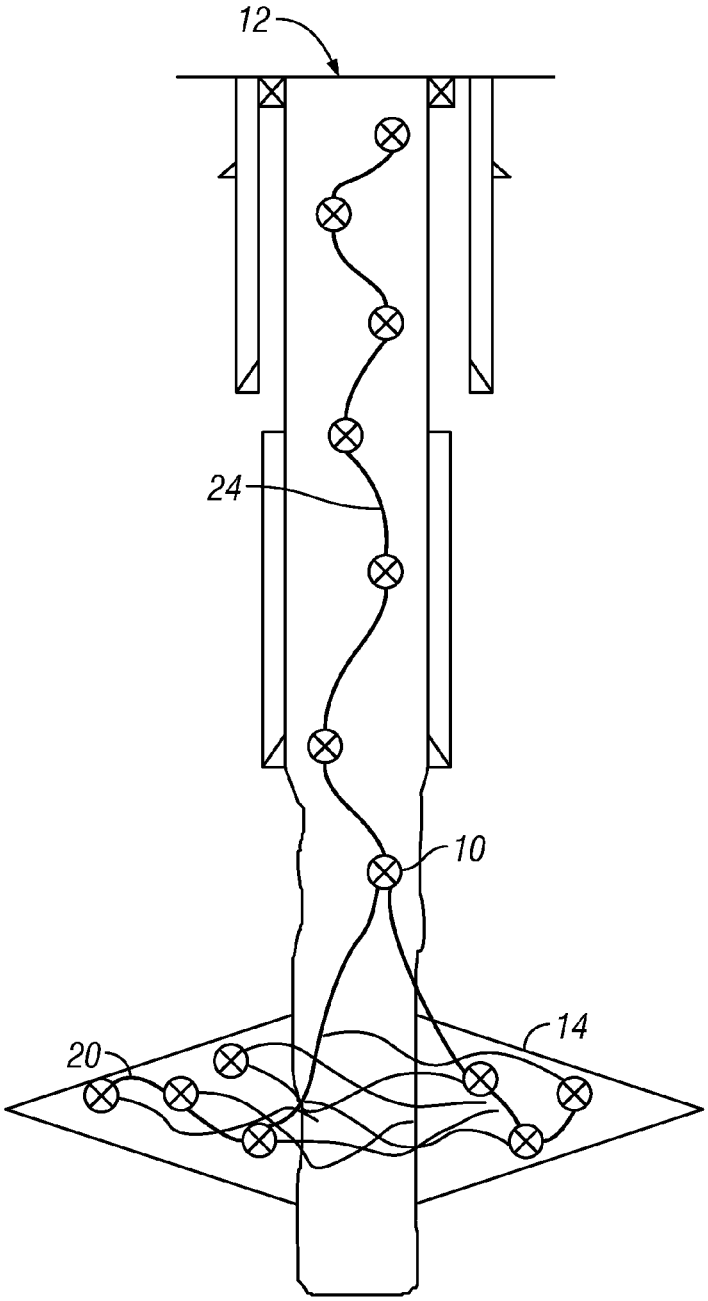
FIG. 6 is a schematic diagram showing LW tags in the thief zone of FIG. 2 in peer-to-peer communication to relay information via tags located in the wellbore to a remote or surface reader according to an embodiment.

FIG. 5 is a schematic diagram showing WID tags 10 in the thief zone 14 wherein the tags comprise LW tags in a peer-to-peer network 20 to relay information such as location from tags 22 that may be disposed out of range to a reader (see FIGS. 3 and 4) in the wellbore 12 according to an embodiment. FIG. 6 is a schematic diagram showing LW tags 10 in the thief zone 14 in a peer-to-peer network 20 including a relay 24 via tags located in the wellbore 12 to a remote or surface reader (not shown) according to an embodiment.

A fluid to entrain an WID tag(s) can comprise a drilling mud, including, but not limited to oil base and synthetic base fluids. A fluid with a low dielectric constant, i.e., the ratio of the permittivity of a medium to that of free space, can increase the transmit range and/or read range of an RFID tag or reader. An oil and/or synthetic based fluid, e.g., drilling fluid, can have a low dielectric constant. Oil has a dielectric constant of about 2.1 at 20° C. (68° F.), air about 1, and water about 80 at 26.7° C. (80° F.). Oil and water emulsions generally have a mixture dielectric constant between water (80) and oil (2), depending on the oil and water content and whether the mixture is oil-continuous (invert emulsion) or water-continuous, as described in U.S. Pat. No. 6,182,504 to Gaisford incorporated herein by reference. This means that the RFID tagging to locate lost circulation zones is more effective in oil based or synthetic drilling fluids which are generally more expensive and less desirable to lose than aqueous-based drilling fluids. In embodiments, a fluid can have, but is not limited to, a dielectric constant less than about 80, 50, 30, 20, 15, 10, 5, 3, 2.5, 2.1, 2, 1, 0.1, 0.01, 0.001, or any range therein.

A fluid can be selected with a dielectric constant less than water, air, or oil, e.g., to increase transmit range and/or read range of an RFID tag or reader. By taking the dielectric constant of the fluid into account the reader can process the signal from the RFID tag to determine the distance of the RFID tag from the reader, in an embodiment. For example, the reader can include a sensor of the type in U.S. Pat. No. 6,182,504 to Gaisford in an embodiment to determine the electrical properties of the fluid.

In one embodiment, a WID tag(s) 10 is entrained in the fluid, and the slurry of the fluid and WID tag(s) can be injected into the wellbore 12. As used herein, wellbore can refer to a bore hole formed in a formation and/or any tubulars or other apparatus disposed at least partially within the bore hole. A wellbore can include at least one casing string therein, as is known the art.

In one embodiment, at least one WID tag is entrained in a fluid in a wellbore. A fluid having at least one WID tag can be tracked in the wellbore by utilizing at least one reader. The location of the WID tag can be determined with a reader or a plurality of readers. It is appreciated that a reader and/or WID tag can be thousands of feet below the surface. Locating can include physical location and/or location relative to a given time. Locating can include determining when and/or if a WID tag is read by a reader, e.g., the WID tag transmits a signal to a reader. It is appreciated that a plurality of embodiments are possible, including, but not limited to, those with static and/or dynamically displaced reader(s) and static and/or dynamically displaced WID tag(s). At least one WID tag entrained in a fluid can allow inventory tracking of the fluid itself, for example, fluid in mud pits, and, in one embodiment, not a container.

A reader can be stationary or dynamically moved within the wellbore. A reader can be disposed in the wellbore, for example, on a wireline cable (see FIG. 3) or on an outer surface of, in a wall of, and/or in the bore of a drill string, casing string, or other conduit (see FIG. 4). A plurality of readers can be disposed along an axial length and/or circumference of a wireline cable, drill string, or casing string, for example. A casing string can be stationary in the wellbore. A drill string can be stationary in the wellbore, operated according to typical drilling practices, or dynamically moved, e.g., displaced, along a predrilled section of wellbore. A reader can be displaced along an axial length of a drill string or casing string. A reader can be encapsulated, for example, in a housing and/or resin, such as epoxy. Encapsulation material can have a low dielectric constant, for example, less than about 20, 10, 5, 2, 1, 0.1, 0.01, 0.001, 0.0001, 0.00001, or any range therein.

A signal broadcast from a WID tag can be read by a reader disposed at the surface, e.g., stationary. Alternatively or additionally, a reader disposed in the wellbore can read the signal broadcast by a WID tag and transmit the identification information corresponding to the WID tag to the surface, e.g., by wireline, or store the information as a log, which can be read on return to the surface. In the case of LW tags, a peer-to-peer network can be used to relay location and other information to a reader in the wellbore (see FIG. 5); or in an embodiment wherein the LW tags are circulated or otherwise form a continuous chain of tags within range of adjacent tags, to a reader at a remote location from the thief zone or even at the surface (see FIG. 6). In an embodiment where there is not a continuous relay channel up the length of the wellbore to a surface reader, the circulated LW tags can communicate network information to the surface reader upon recovery of the tags at the surface.

In one embodiment, a reader can be disposed adjacent a location of interest, e.g., an outlet or distal end, of a drill string, casing string, or conduit to allow the reading of a WID tag, for example, if a WID tag entrained in fluid is proximate to or otherwise within range of the reader. One specific, non-limiting application of this can be if the fluid is motive, the reader can determine the presence of a WID tag passing within its read range, and thus function as a tracer to track the fluid having the WID tag entrained therein. A reader can be disposed on and/or within a sub, which can be connected to a drill string, so as to be compatible with a bottom hole assembly. A reader can be a component unitary to a bottom hole assembly. Communication between the reader and a surface location can be achieved, for example, by mud pulse technology, wireline, fiber optic, or any other downhole communication and/or data transmission methods known in the art. Alternatively or additionally, the reader can record a log of WID readings that is read when the reader is retrieved at the surface in an embodiment.

In one embodiment, a plurality of readers can be disposed throughout a wellbore, including a bore and/or outer surface of a drill string, casing string, or other tubular disposed in the wellbore. In such an embodiment, the plurality of readers can utilize a known location of each reader to determine location of any WID tag entrained in the fluid. For example, if the fluid is flowing through the wellbore, the movement of the fluid can be ascertained as the location of the WID tag, e.g., at a specific time, is known. Movement of a WID tag, which can closely approximate the movement of the carrier fluid itself, can be used to determine velocity, acceleration, etc.

In one embodiment, a plurality of WID tags can be added to a fluid in the wellbore, for example, a drilling fluid pumped from the surface. Drilling fluid with entrained WID tags can be tracked within the bore of a drill string it is pumped through (e.g., by including at least one reader in the bore of the drill string) and/or tracked within an annulus formed between the outer surface of the drill string and the wellbore (e.g., by including at least one reader in the annulus).

A WID tag, or tags, entrained in a fluid can be used as a tracer. For example, a fluid entrained with WID tag(s) can be utilized as a tracer slug, e.g., injected into another fluid, or the fluid entrained with WID tag(s) itself can be the fluid whose location, etc. is ascertained. In one embodiment, a reader can be disposed in the wellbore and utilized to determine when and/or if the fluid with entrained WID tag(s) reaches the location of the reader (e.g., read range). For example, a reader can be disposed at one location, and the time it takes an WID tag(s) entrained in fluid to flow from a first location, e.g., the surface, to the reader can be determined. Circulation time, etc., can be determined from this time measurement. Tracking a WID tag(s) can allow tracking of fluid paths and/or fluid velocity. If a WID tag(s) can be disposed into the formation, e.g., through a wall of the wellbore, the WID tag(s) can be utilized to later identify a core(s) and/or fluid(s) sampled from the formation. Other tracer methods known in the art can be utilized with this entrained WID tag tracking method without departing from the spirit of the invention.

At least one WID tag entrained in a fluid in the wellbore can be used to detect a fluid loss, e.g., an area of the wellbore where circulation is lost. Such methods can be used to evaluate a hydraulic fracture treatment. If there is a fluid loss from a wellbore, a WID tag entrained in the fluid in wellbore can flow into (e.g., if the WID tag is of appropriate size relative to the fluid loss aperture or opening) or at least adjacent to, the zone of fluid loss in the wellbore. At least one reader can then be utilized to locate the WID tag, which in that embodiment corresponds to the fluid loss.

In another embodiment, a plurality of WID tags can be entrained within a fluid in the wellbore and the WID tags can flow into (e.g., if the WID tag is of appropriate size relative to the fluid loss aperture or opening) or at least adjacent to, the zone of fluid loss in the wellbore. At least one reader can then be utilized to locate a concentrated zone of WID tags, which in that embodiment will correspond to an area, or areas, of fluid loss.

Locating a WID tag can include displacing a reader within the wellbore until the WID tag is located, e.g., as the depth of the reader can be known. Additionally or alternatively, a plurality of readers can be disposed and/or displaced in the wellbore. For example, a plurality of readers can be disposed on the inner and/or outer surface of a drill string, a casing string, or other conduit in the wellbore.

In one particular embodiment, a drill string can have a plurality of readers disposed along an inner and/or outer surface of the drill string, e.g., to read radially and/or axially, and the concentrated zone of WID tags can be located without displacing the drill string along a length of wellbore. However, a drill string can be displaced radially and/or axially, with the readings converted into geostationary location(s) through standard methods known in the art, e.g., knowing the rate of rotation and/or axially displacement of the drill string. Such an embodiment can allow for a depth and/or azimuth reading corresponding to a particular WID tag to be ascertained.

Additionally or alternatively, at least one WID tag entrained in a fluid in the wellbore can be used to detect a fluid void, e.g., an area of the wellbore where the particular fluid is not present. If there is a fluid void in a wellbore, no WID tag will be located in that zone. At least one reader can be utilized to locate the areas lacking a WID tag, which in that embodiment will correspond to the fluid void.

In one particular, non-limiting example, a plurality of WID tags can be entrained within a fluid in the wellbore, (e.g., cement or a well treatment fluid). At least one reader can be utilized to locate a zone devoid, or substantially devoid, of WID tags, which in that embodiment will correspond to an area, or areas, devoid of the fluid, i.e. free of lost circulation zones. Locating a WID tag can include disposing a single reader within the wellbore until the devoid areas are located, e.g., as the depth of the reader can be known. Additionally or alternatively, a plurality of readers can be disposed and/or displaced in the wellbore. For example, a plurality of readers can be disposed on the inner and/or outer surface of a drill string, a casing string, or other conduit in the wellbore.

Figure 7:
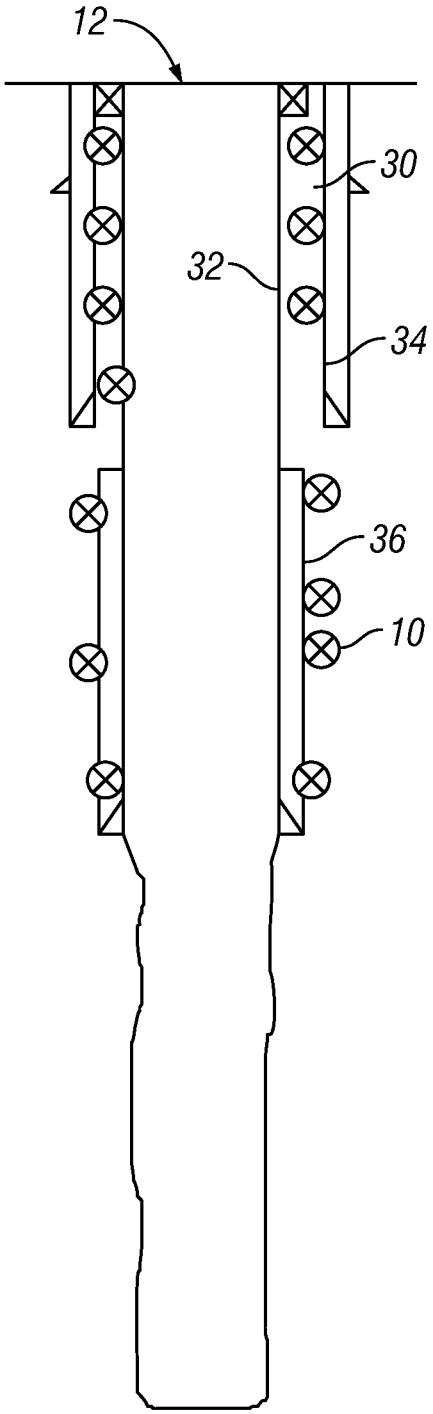
FIG. 7 is a schematic diagram showing WID tags in an annulus between casings and in an annulus between a casing and the formation to indicate the quality of a cement job according to embodiments.

In one particular embodiment, a casing string can be disposed in a wellbore for cementing, as is known the art. FIG. 7 is a schematic diagram showing WID tags 10 in a first annulus 30 between casings 32, 34 and in a second annulus 36 between the casing 32 and the formation, to indicate the quality of a cement job according to embodiments. The casing string 32, or a separate drill string or tubular (e.g., production tubing), can have a plurality of readers disposed along an inner and/or outer surface thereof, e.g., to read radially and/or axially. A fluid, e.g., cement, can be pumped into the wellbore, or more particularly, the annulus between the outer surface of the casing string and the wellbore 12 and/or any other casing string which may be present. A reader or readers can be utilized to locate any areas devoid of WID tags, which will correspond to areas devoid of cement in this location as the WID tags are entrained in the cement. This can be useful, for example, to identify if a sufficient bond between the casing and the wellbore is formed and/or if the cement did not reach the desired area of the annulus. A plurality of WID tags 10 disposed throughout solidified cement can allow monitoring of the solidified cement, e.g., by locating any areas devoid of WID tags which can correspond to an area devoid of cement.

As discussed above, WID tag(s) can be located without displacing the reader along a length of wellbore. However, a reader can be displaced radially and/or axially, with the readings converted into geostationary location(s) through standard methods known in the art, e.g., knowing the rate of rotation and/or axially displacement of the reader. Such an embodiment can allow for a depth and/or azimuth reading corresponding to a particular WID tag to be ascertained.

Embodiments can include, but are not limited to, a moving reader and stationary and/or moving single WID tag, a moving reader and stationary and/or moving plurality of WID tags, a stationary reader and stationary and/or moving single WID tag, and/or a stationary reader and a stationary and/or moving plurality of WID tags. A reader can be displaced in and out of the wellbore, for example, as in a logging operation.

Figure 8:
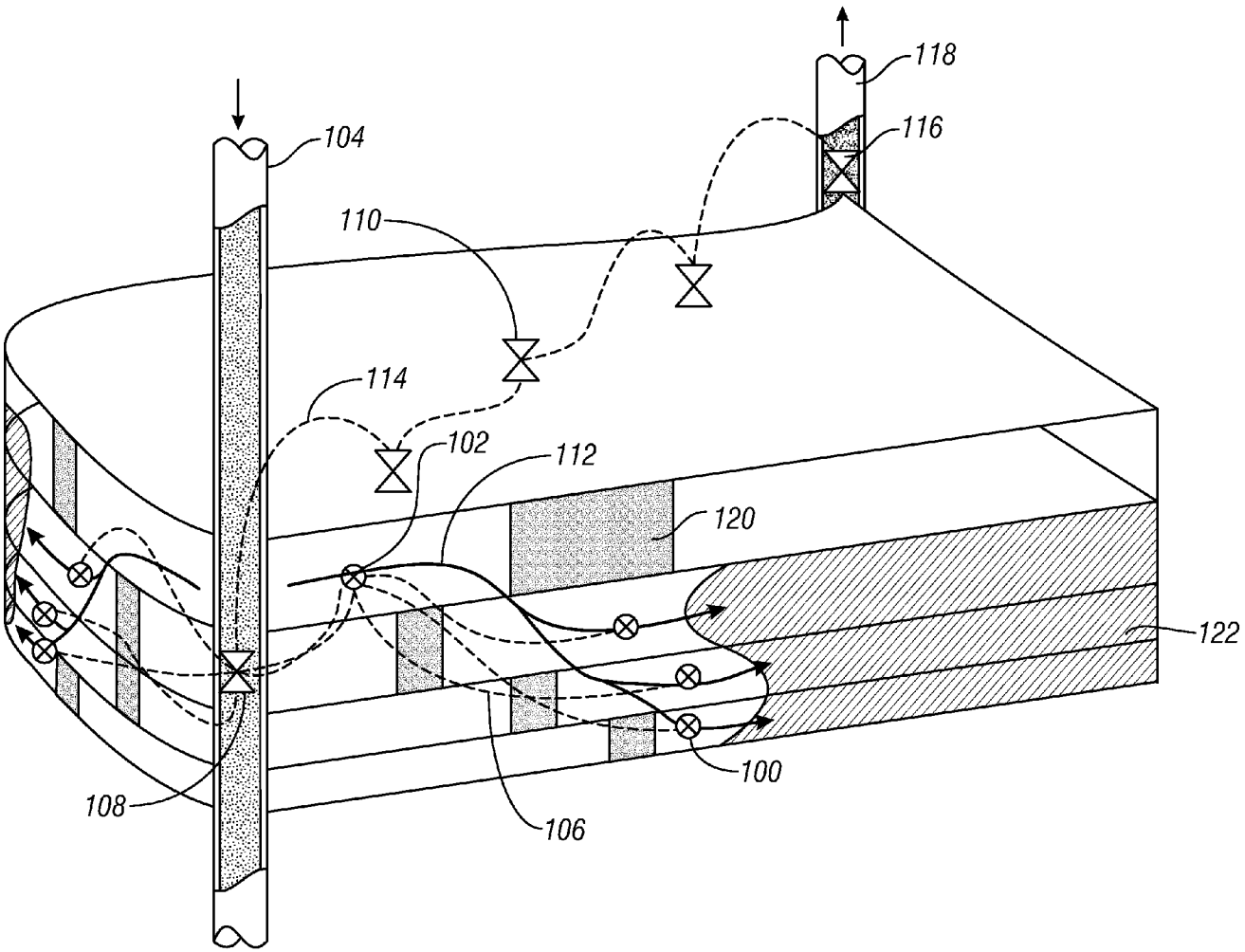
FIG. 8 is a schematic showing LW tags in peer-to-peer communication in a waterflood to relay information such as location to readers according to an embodiment.

FIG. 8 is a schematic showing remote LW tags/clients 100 and proximal LW tags/clients 102 relative to a water injection well 104 in a peer-to-peer network 106 in a waterflood operation to relay information such as location to downhole readers/servers 108 and vertically offset readers/servers 110 according to an embodiment. In an embodiment, the tags 100, 102 can be added to the flood water 112 and monitored by a network 114 of the readers 108 in the injection well 104, vertically offset readers 110 and readers 116 in the production well 118. In an embodiment, the vertically offset readers can be positioned on the surface or in a downhole structure such as a horizontal well. Even when the tags 100 are beyond the reception range of any readers, the tag peer-to-peer protocol ensures that all tag locations can be accounted for. In an embodiment, triangulation of tag transmission via multiple reception locations, by a plurality of the readers 108, 110 or 116, by a plurality of the tags 100, 102, or any combination of tags and readers, will give precise tag depth and directional location information.

In an embodiment illustrative of an exemplary waterflood system, the BRIGHT WATER system available from the Nalco Company can include thermally activated sub-micron diversion particles dispersed in the flood water 112 which inhibit flow in water passages 120 that have pushed ahead of the main flood to divert the flood water 112 vertically and horizontally to poorly swept zones that contain more oil. Thus, the volume of oil 122 swept to the production well 118 is increased. By tracking the location of the tags 100, 102 entrained in the mobile flood water 112 and the stationary diversion zones 120, the progress of the waterflood can be evaluated and adjusted, in an embodiment, by changing the rate, location, chemical or physical composition of the flood water, the rate of oil production, any combination thereof, or the like.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A system to track a fluid in a wellbore comprising:

a visibility network of wireless identification (WID) tags comprising peer-to-peer long wavelength (LW) tags operable at a frequency less than 450 KHz and a data rate of 300 to 9600 baud entrained in a fluid to form a slurry;

at least one reader disposed within the wellbore within range of the visibility network; and one or more of the peer-to-peer LW tags in the visibility network disposed in a zone beyond range of the at least one reader, wherein the beyond-range peer-to-peer LW tags are locatable by the at least one reader via the visibility network.

2. The system of claim 1 wherein the at least one reader is disposed on a drill string.

3. The system of claim 1 wherein the at least one reader is disposed on a casing string.

4. The system of claim 1 wherein the visibility network comprises multiple reception locations for triangulation to obtain tag depth and directional location.

5. The system of claim 1 wherein the WID tags employ IEEE standard 1902.1.

6. The system of claim 1 wherein the LW tags comprise active transceivers.

7. The system of claim 1 wherein the LW tags have IP addresses for identification.

8. The system of claim 1 wherein the slurry is disposed in an annulus between an outer surface of a first casing string disposed in the wellbore and at least one of the wellbore and an inner surface of a second casing string circumferential to the first casing string.

9. The system of claim 1 wherein the slurry is disposed in an annulus between an outer surface of a drill string and an inner surface of the wellbore.

10. The system of claim 1 further comprising a concentrated zone of the WID tags in the wellbore adjacent a fluid loss zone.

11. The system of claim 1 wherein the WID tags are entrained substantially uniformly in the slurry.

12. The system of claim 1 further comprising a fluid void detectable by the at least one reader as a zone in the wellbore substantially devoid of the WID tags.

13. The system of claim 1 wherein the WID tags comprise sensors to transmit sensor data to the at least one reader.

14. The system of claim 1 wherein data can be written to the WID tags in the wellbore.

15. The system of claim 1 wherein the fluid comprises a drilling fluid comprising a dielectric constant less than about 50.

16. The system of claim 1 wherein the fluid comprises an invert emulsion.

17. The system of claim 1 wherein the beyond range zone comprises a thief zone.

18. The system of claim 1 wherein the beyond range zone comprises a fracture.

19. The system of claim 18 wherein the fluid comprises a fracturing fluid comprising dispersed, thermally activated sub-micron diversion particles.

20. The system of claim 1 wherein the beyond range zone comprises a waterflood.

21. The system of claim 1 wherein the fluid comprises the WID tags disposed in a tracer slug disposed in the wellbore.

* * * * *